US009328955B2

(12) United States Patent
Castro Solis et al.

(10) Patent No.: US 9,328,955 B2
(45) Date of Patent: May 3, 2016

(54) TILTABLE DRAWER

(71) Applicant: MABE, S.A. DE C.V., Santiago de Queretaro, Queretaro (MX)

(72) Inventors: Luis Francisco Castro Solis, Queretaro (MX); Lazaro Duarte De Robles, Queretaro (MX); Juan Suarez Gonzalez, Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 0 days.

(21) Appl. No.: 14/560,560

(22) Filed: Dec. 4, 2014

(65) Prior Publication Data

US 2015/0176887 A1 Jun. 25, 2015

(30) Foreign Application Priority Data

Dec. 19, 2013 (MX) ..... MX/A/2013/015302

(51) Int. Cl.
*F25D 25/00* (2006.01)
*F25D 25/02* (2006.01)

(52) U.S. Cl.
CPC ..... *F25D 25/025* (2013.01); *F25D 2500/02* (2013.01)

(58) Field of Classification Search
CPC ..... A47B 88/06; A47B 88/18; F25D 25/025; F25D 23/028; F25D 23/04
USPC ..... 312/404, 402, 323
See application file for complete search history.

(56) References Cited

U.S. PATENT DOCUMENTS 222,816 A 12/1879 Daniel
321,078 A 6/1885 Birckhead
1,108,281 A 8/1914 Uffner
2,266,870 A 12/1941 Kraft
3,722,975 A * 3/1973 Taylor ..... 312/334.44
3,975,071 A 8/1976 Quinn
4,186,978 A * 2/1980 Thomson ..... 312/321.5
(Continued)

FOREIGN PATENT DOCUMENTS

CN 1940438 4/2007
CN 201672758 12/2010
(Continued)

*Primary Examiner* — Daniel Rohrhoff

(74) *Attorney, Agent, or Firm* — Terry M. Sanks, Esq.; Beusse Wolter Sanks & Maire, PLLC

(57) ABSTRACT

A refrigerated cabinet having a cabinet, thermal insulation, cover or liner, which help it form a cavity which can house objects to be refrigerated with at least one shelf and one door comprising a vegetable drawer which itself on its lateral and opposite walls having an appendage integrated by a head, an upper crossbar, a lower crossbar, a skate, a hump; which runs within a rail comprising a channel formed by a barrier, a lower bay, a neck in C with a straight which is inclined, a gulf and a stump; with the peculiarity that when the vegetable drawer is found in its resting or closed position, the front wall of said vegetable drawer is in close proximity to the vertical; the head (32) is coupled within the neck in C, the skate is in contact with the upper face of the lower bay, and the barrier is in contact with a portion of the lower face of the lower crossbar; and that when the vegetable drawer is extracted in its final runner position, the vegetable drawer has an α inclination with relation to the horizontal; wherein the head (32) is coupled unto the gulf of the rail, and the barrier is in contact with a lateral face of the skate, as well as with a portion of the lower face of the lower crossbar.

6 Claims, 10 Drawing Sheets

Step 4

(56) References Cited

U.S. PATENT DOCUMENTS

| | | | | |
|---|---|---|---|---|
| 4,368,866 | A | 1/1983 | Urban | |
| 4,441,771 | A | 4/1984 | Roesler | |
| 4,725,108 | A | 2/1988 | Wilson | |
| 5,119,942 | A | 6/1992 | McCullars | |
| 5,213,401 | A | 5/1993 | Hatcher | |
| 5,306,077 | A | 4/1994 | Trevaskis | |
| 5,820,239 | A * | 10/1998 | Christenson et al. | 312/334.23 |
| 6,674,030 | B2 * | 1/2004 | Chen et al. | 200/86.5 |
| 6,742,855 | B2 * | 6/2004 | Whitaker et al. | 312/405.1 |
| 7,090,316 | B2 | 8/2006 | Model | |
| 7,472,974 | B2 * | 1/2009 | Czach et al. | 312/405.1 |
| 7,775,613 | B2 * | 8/2010 | Williams | 312/321.5 |
| 8,585,163 | B2 * | 11/2013 | Park | 312/332.1 |
| 8,864,252 | B1 * | 10/2014 | Rodriguez Cobas et al. | 312/405.1 |
| 2004/0012314 | A1 * | 1/2004 | Hay et al. | 312/405.1 |
| 2005/0248245 | A1 * | 11/2005 | Ceccarelli et al. | 312/323 |
| 2013/0119844 | A1 * | 5/2013 | Seo et al. | 312/404 |
| 2014/0312758 | A1 * | 10/2014 | Gossens et al. | 312/404 |

FOREIGN PATENT DOCUMENTS

| | | |
|---|---|---|
| CN | 202122331 | 1/2012 |
| FR | 2500605 | 8/1982 |
| JP | 01219487 | 9/1989 |
| JP | 10054655 | 2/1998 |
| JP | 3573909 | 9/1998 |
| JP | 4499379 | 7/2010 |
| JP | 3164972 | 12/2010 |
| KR | 100222986 | 10/1999 |
| KR | 101030484 | 4/2011 |
| WO | 03036199 | 5/2003 |
| WO | 2012025369 | 3/2012 |

* cited by examiner

Step 1

Step 2

Step 3

Step 4

TILTABLE DRAWER

CROSS-REFERENCE TO RELATED APPLICATIONS

This application claims priority to Mexican Patent Application No. MX/a/2013/015302 filed Dec. 19, 2013, and incorporated herein by reference in its entirety.

BACKGROUND

The present invention relates to household refrigerators, particularly to vegetable drawers set within said household refrigerators; knowing that in the majority of household drawers, the drawers for vegetables are found in the lower part of the refrigeration compartment, said drawers are normally manufactured of some translucent thermoplastic, which allows the user to be able to see into the inner part thereof, and additionally, these drawers are relatively large in relation to the space of the refrigerator compartment, given that the vegetables require a large storage space given their size; another question which should be taken into consideration is the humidity required to maintain said drawer, so that in many designs this isolates in a certain manner, the vegetables from the cold and dry air which circulates throughout the refrigeration compartment, all of these considerations as well as others, both engineering ones as well as resistance, efforts, weight etc. factors are considered by the engineers and designers of household refrigerators; however the large majority of these designs fail to consider a drawer which is easily extractable, has low cost, which allows a large opening in order to be able to introduce or extract the vegetables or objects to be introduced into it, in addition to, allowing for the user's comfortable posture, improving the vision angle when the drawer is open and eases the grasping of the vegetables or other objects to be introduced. Thereby, present invention solves these and other problems in an ingenious, creative and additionally novel manner.

BRIEF DESCRIPTION OF THE INVENTION

We are all familiar with the use of drawers; we are able to find these everywhere, they may serve as support, as storage for objects, they offer the ability of being able to order our utensils or belongings in a particular place and make them disappear so that they do not obstruct when closing the drawer; drawers are formed by a type of runner, set over the body or furniture which grants them support and a protuberance which is set on the vertical sides of the drawer, wherein said protuberance is in contact with the runner with such luck that there is relative movement between these upon introducing or extracting the drawer; this mechanism may have a large or small amount of friction, depending on how much the extraction sensation wants to be complicated or improved upon, because runner or telescopic supports can be mounted based on pellets or bearings, wheels on a runway, several contact points in order to reduce friction, among others, which then obviously increases the cost of the drawer per se, now then, upon extracting a drawer so that its contents may be exposed, often times the final position of the drawer does not aid in being able to see its content or upon grabbing an object found within the drawer, its extraction might not be easy given the aperture area of the drawer; thus the present invention is comprised of an ingenious low-cost runner system, lacking moving parts which might require maintenance, allows a greater opening or extraction area, as well as a better visualization angle and better extraction of vegetables or other objects introduced within it. The vegetable drawer of present invention has a support set on its sides in a protrusion manner, which in beam-like manner comprises a skate which slides over the lower part of the bay of the runner which is set over the liner or plastic wall of the refrigerator cabinet; the back part of the support is set with a cam-follower type head, which upon extracting the drawer from the head comes into contact with the upper part of the rail set over the liner, which controls and limits the nodding or tilting of the vegetable drawer when being extracted, up until the head arrives at a gulf which it couples unto, thus limiting the running and tilting of the drawer; this novel mechanism allows a tilting or nodding of the vegetable drawer which allows for a greater aperture than the one which would be achieved if the drawer were only allowed to be extracted in a horizontal manner.

DETAILED DESCRIPTION OF THE INVENTION

A refrigerated cabinet comprises a cabinet 10, which contains a cover or liner 11 where in a framework manner, foam is present there between which grants thermal resistance in addition to granting structure to the cabinet 10 ensemble, the foam as a thermal insulator and the liner 11, the cavity formed by the liner 11 (described as cavity 14 from here on) is closed by means of at least one door 12, which is also formed by a "tray", preferably metal, over which another cover or door liner is placed and between them in a framework manner, a foam is present which grants thermal resistance, through which thermal insulation of the door is achieved; in the majority of cases the door on its periphery has a seal provided which does not allow the exiting of cold air or the entrance of warm air to be introduced into the cavity 14 formed by the liner 11 while the door is closed, in some instances, the door can comprise some closing mechanism which keeps the door closed or in the great majority of cases, the referred to seal may contain within it a magnet or a series of magnets which allow the seal to have a uniform contact area over the face of the cabinet 10.

Figure 1:
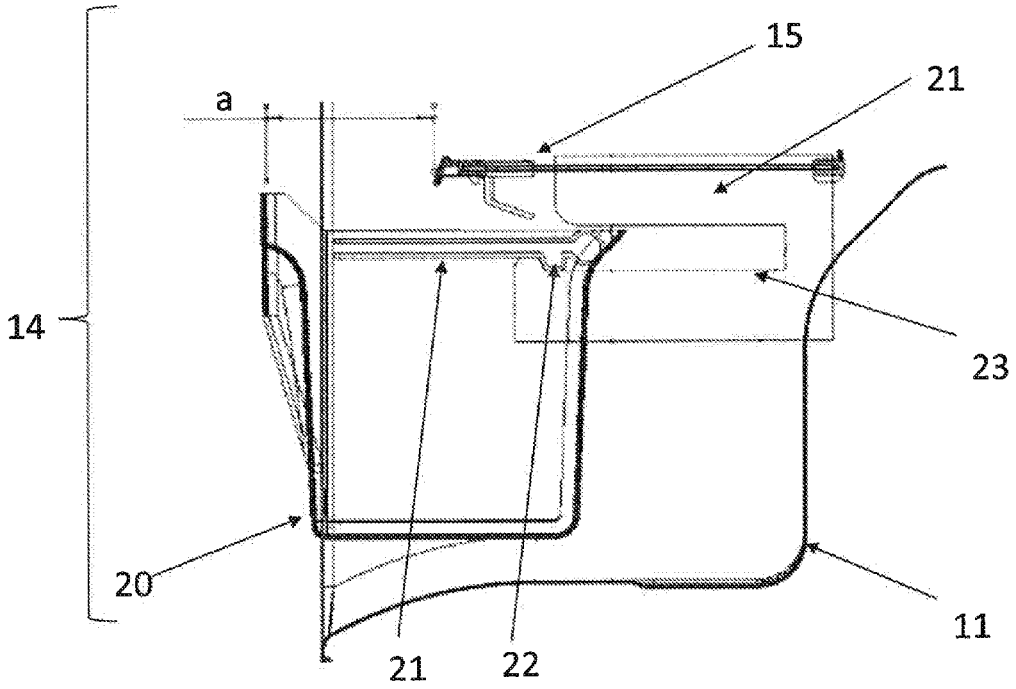
Prior Art Figure 1
FIG. 1 is a lateral view without the cover or liner wherein the vegetable drawer and runner of previous art can be seen.

The cavity 14 may house a series of shelves which may be different shapes, types and materials; the most common are glass shelves framed with some thermoplastic, another type are shelves made of steel rods or iron recoated with paint, these are commonly known as grills, another type of shelf is completely formed by one or several thermoplastic pieces, whether it is translucent or opaque; the referred to shelves can take different positions within the cavity 14, depending on the user's needs, as well as the means which the liner 11 can comprise to grasp them or to grant them support; now then, normally on the lower part of the cavity 14 at least one vegetable drawer 20 can be found, such as is illustrated in FIG. 1, said vegetable drawer 20 can be supported by means of some runners 21 found on the vertical walls of the liner 11, said runners 21 house the support 22 within a groove 23, which runs along the lower horizontal face of the runner 21, which in many cases can create high friction which can damage the components with the passage of time, in addition to the difficulty of being able to extract or retrieve the vegetable drawer 20, furthermore the possibility of only being able to horizontally extract the vegetable drawer 20 only allows to have an "a" aperture, measured between the front end of the shelf 15 and the inner face of the front wall of the vegetable drawer 20, it being obvious from FIG. 1 that the groove 23, upon having its lower wall as well as its upper wall straight, horizontally restrict the movement of the support 22, and thus thereby restrict the movement of the vegetable drawer 20.

Figure 2:
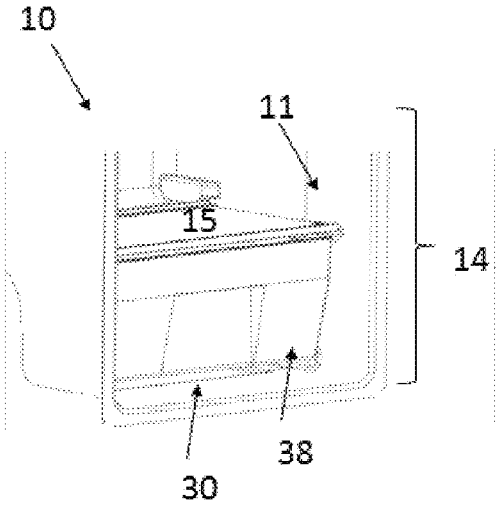
FIG. 2 is an isometric view of the vegetable drawer of present invention in its resting or closed position.
Figure 3:
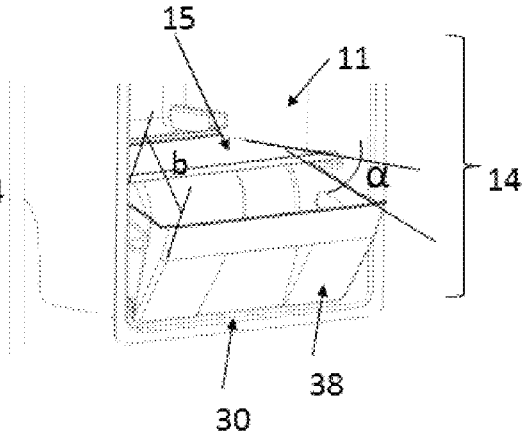
FIG. 3 is an isometric view of the vegetable drawer of present invention in its extracted or open position.

Now then, turning our attention to FIGS. 2 and 3, we can see the vegetable drawer 30, of the present invention, in its resting (closed) position as well as in its extracted or open position, and note that the shelf 15 also serves as a lid or upper cover to the vegetable drawer 30, we can also discern in FIG. 3, that upon the vegetable drawer 30 being completely extracted, a "b" aperture exists, as well as a tilting angle "α" in relation to the horizontal, the referred to "b" aperture has a greater size than the "a" aperture of prior art, in addition to angle "α" allowing better view of the objects or vegetables introduced within the drawer, as well as an improvement in the user's posture when extracting them, it also grants a greater extraction area which additionally eases the ability of introducing or extracting vegetables or other objects into or from the vegetable drawer 30.

Figure 4:
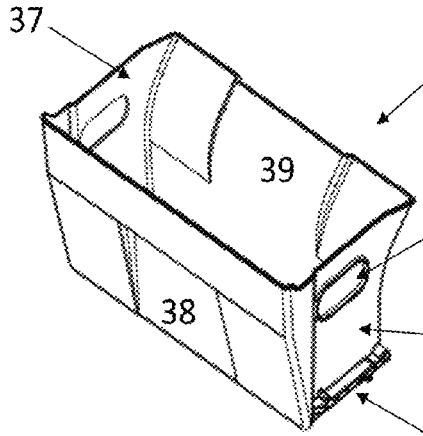
FIG. 4 is an upper isometric view of the vegetable drawer of present invention.
Figure 5:
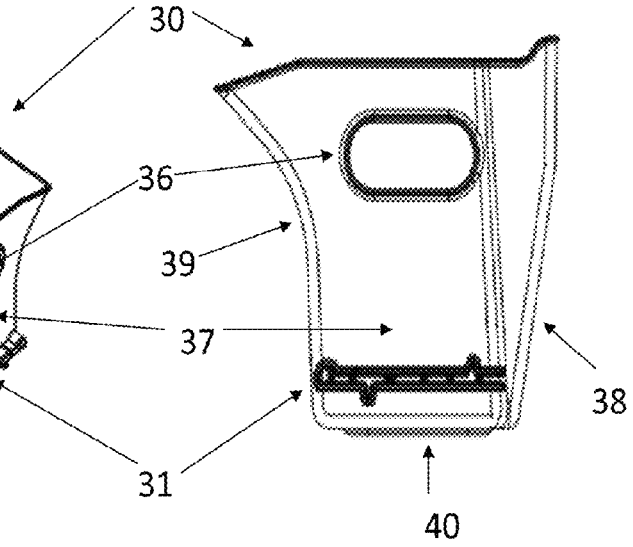
FIG. 5 is a lateral view of the vegetable drawer of present invention.

FIGS. 4 and 5 are of great usefulness in illustrating the vegetable drawer 30 of present invention; from these figures one can see the appendage 32 which has a somewhat peculiar shape, which shall be discussed in detail later on; said appendage helps in guiding the vegetable drawer 30 through the rail 43, as well as in supporting the vegetable drawer 30; the referred to vegetable drawer 30 also comprises a pair of lateral walls 37 which have on their lower part, the appendage 31 protrusion in high relief, over the same lateral walls 37 on their upper part, the handles 36 are found which are a cavity, they are illustrated in oval shape, these having the capability of having any possible shape, with the restriction that they allow the introducing of the use's hand in such a way that the user be able to grasp the vegetable drawer 30 by means of the handles 36; also forming part of the vegetable drawer 30 are: a front wall 38, a back wall 39, as well as a flooring 40, and in this manner, the walls 37, 38, 39 and the flooring 40 make up the body of the vegetable drawer 30 such as is illustrated in FIGS. 4 and 5.

Figure 6:
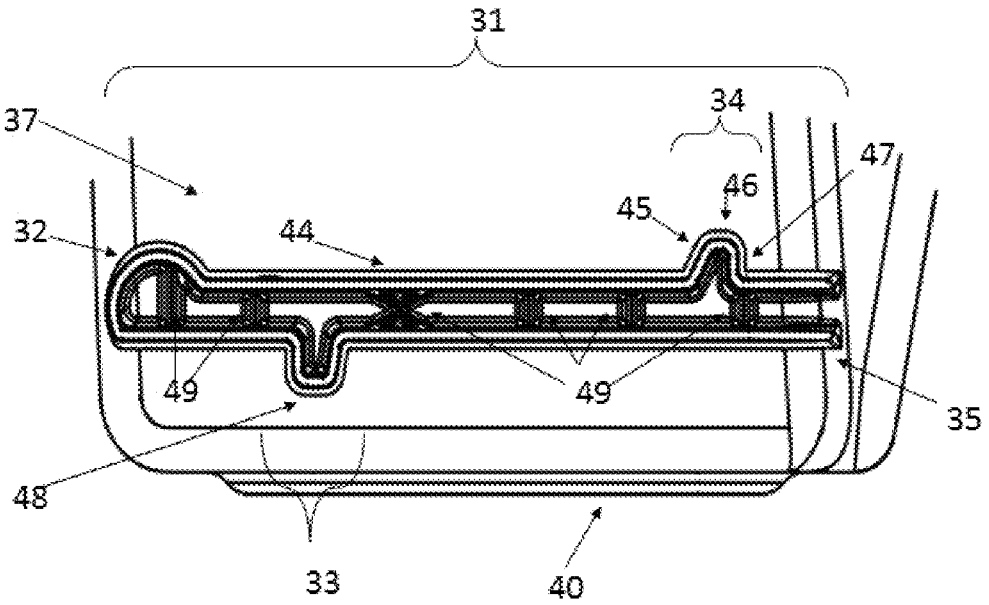
FIG. 6 shows the detail of the lower part of the lateral face of the vegetable drawer of present invention in which the detail on the appendage can be appreciated.

Now then, we shall describe the innovating shape of the appendage 31, which, such as disclosed in the above lines has a high relief protrusion over the lower part of the outer face of the lateral walls 37, each wall has an appendage 31, it is also noted that the referred to walls 37 are opposite to each other; FIG. 6 also helps to illustrate the peculiar shape of the appendage 31; we shall begin by the head 32, which is found at the back end of the appendage 31, said head 32 follows the curve of an arc segment, which arises at the back end of the lower crossbar 35 forming an arc which can measure from 200° up to 270°, this shall depend on the particular design of the vegetable drawer 30 as well as the rail 43, now then, it should be noted that part of the arc of the head 32 exceeds the height of the upper crossbar 44; the configuration of the head as an arc segment helps for better distribution of forces among other benefits and functions; continuing towards the front of the commented upon upper crossbar 44 we find a hump 34 which has a titled wall 45 which ends up in a crest 46 to later return to the upper crossbar 44 by means of a vertical wall 47; returning to the lower cross bar 35, on its back part, we can also find the skate 33, which itself, by means of a pair of walls or another type of curvature has on the part which is most distant from the lower face of the lower crossbar 35, a contact or sliding surface 48; it should be highlighted that at this point, the crossbars 35, 44 may be joined by the reinforcement columns 49 in a preferred embodiment; said reinforcement columns 49 grant greater rigidity to the crossbars 35, 44, thereby also helping improve force distribution.

Figure 7:
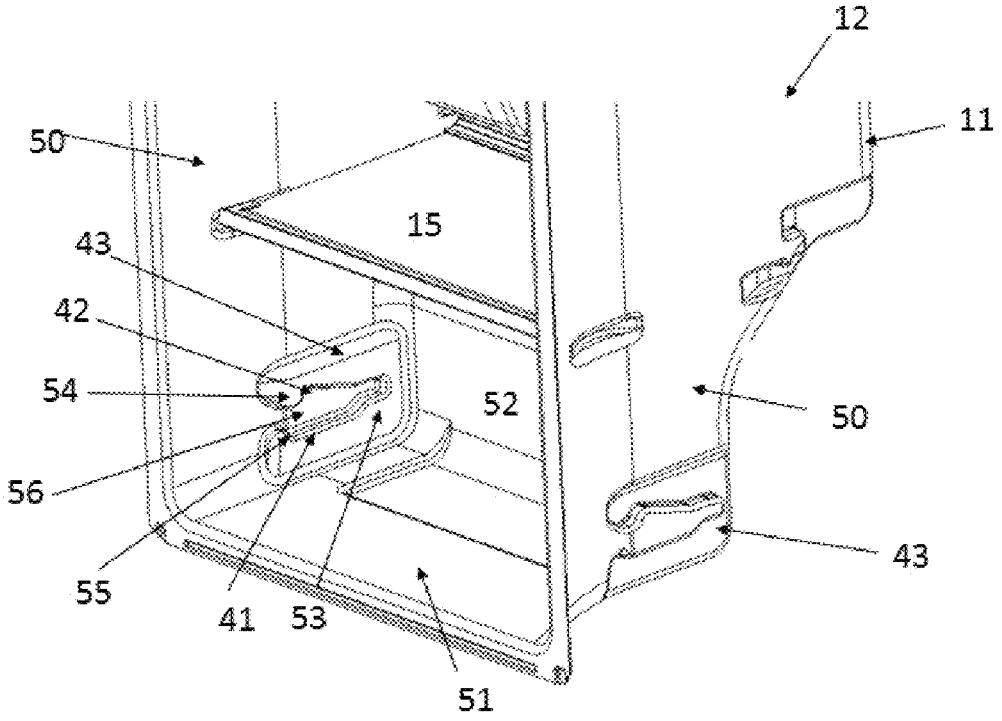
FIG. 7 is an isometric view of the lower part of the cavity of the refrigerated cabinet where the geometry of the rail set over the vertical walls opposite the liner, can be appreciated.

Now then, FIG. 7 shows an isometric view of the lower part of the cavity 14, where the shelf 15, the lower part of the cover or liner 11 can be seen, also the cavity in which the vegetable drawer 30 shall be housed can be discerned, which is formed by the lateral walls 50, the liner flooring 51, the back wall of the liner 52 and the shelf 15; focusing our attention now on the rail 43 which is protruded in high relief towards the center of the refrigerated cabinet; said rail 43 in a preferred embodiment is formed at the lower part of the side walls 50 of the cover or liner 11 itself following some thermoforming process, in a preferred embodiment the referred to rail 43 may be formed separately preferably using engineered thermoplastics, once this is formed, it is fastened unto the liner 11 by means of screws, rivets, glues or another method of thermoplastic welding, with such luck that the side walls 50 which are opposite to each other, would each have their own rail 43 provided.

Figure 8:
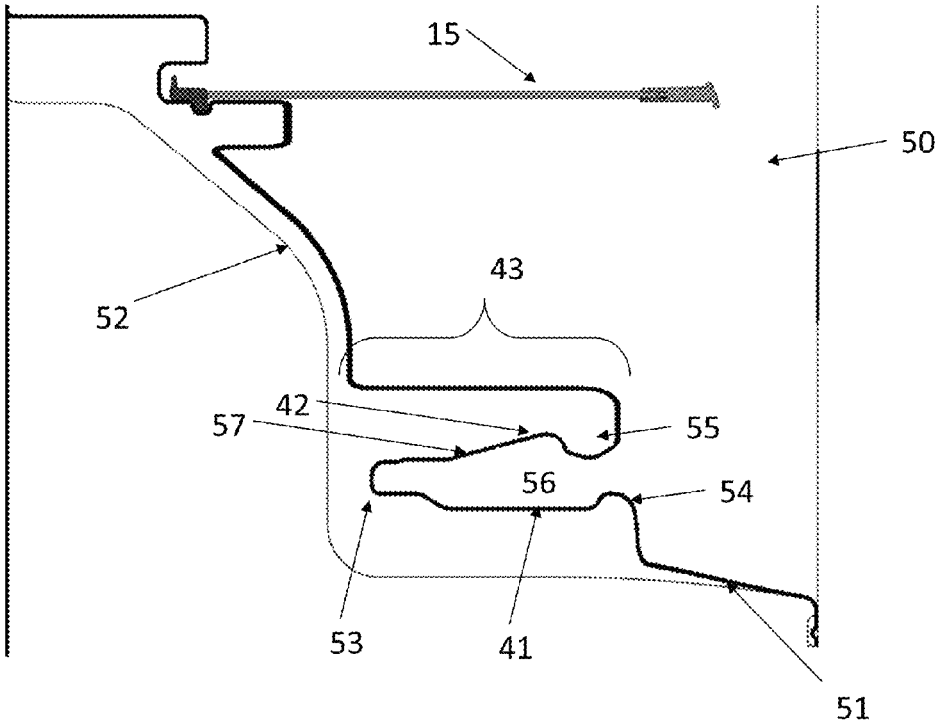
FIG. 8 is a lateral view through the liner without the vegetable drawer in which the geometry of the lower part of the cavity of the refrigerator cabinet as well as the profile of the rail can be appreciated.

FIG. 8 itself shows the silhouette of the rail 43 found on the lateral wall 50, in a cross section view, FIG. 8 together with FIG. 7 will be particularly useful in describing the innovating as well as peculiar shape of the rail 43; the referred to rail 43 is peculiarly formed around a channel 56 which is delimited in a frontal portion by the barrier 54 which is a lower protuberance which together with the stump 55 (upper protuberance) limit the width of the channel 53, adjacent to the barrier 54 towards its back part, the bay 41 is found which is formed by a straight segment with lesser height than the crest of the referred to barrier 54, upon getting to the back part of the channel 53, the width of it is reduced upon finding the neck in "c" 53, which itself on its upper part continues through an inclined straight 57 which ends exactly where the gulf 42 begins forming an arc segment, at the end of which arc segment, the upper protuberance referred to as stump is found, which together with the barrier 54 delimits the width of the channel 53.

Figure 9:
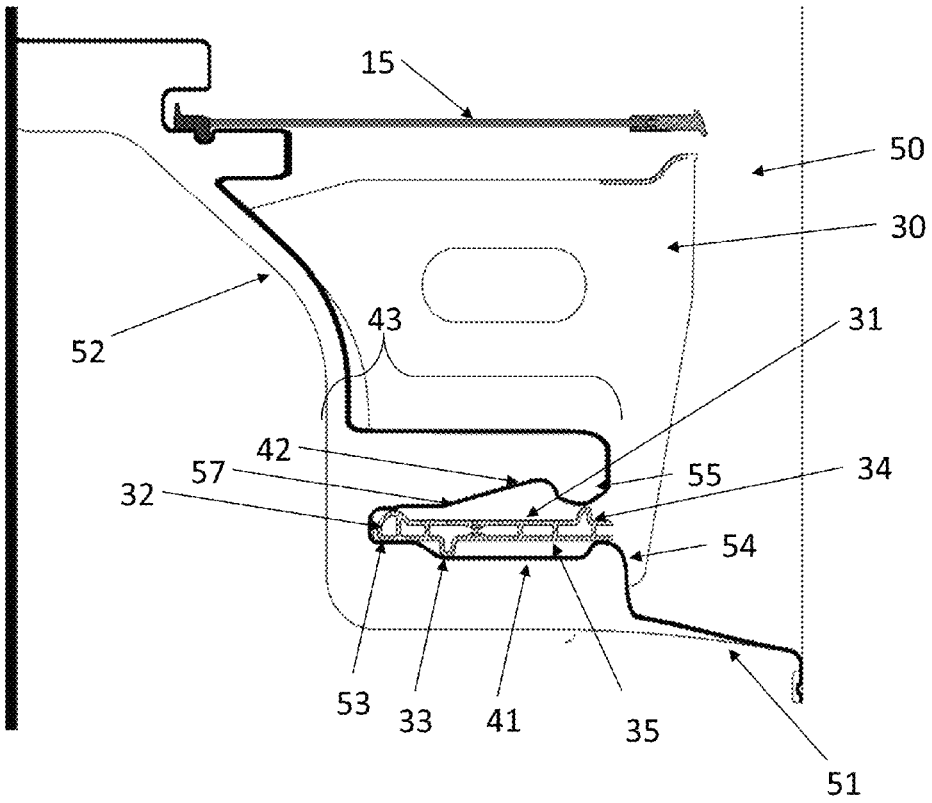
FIG. 9 is a lateral view through the liner with the vegetable drawer in which the vegetable drawer can be appreciated in its resting or closed position, which represents Step 1.
Figure 10:
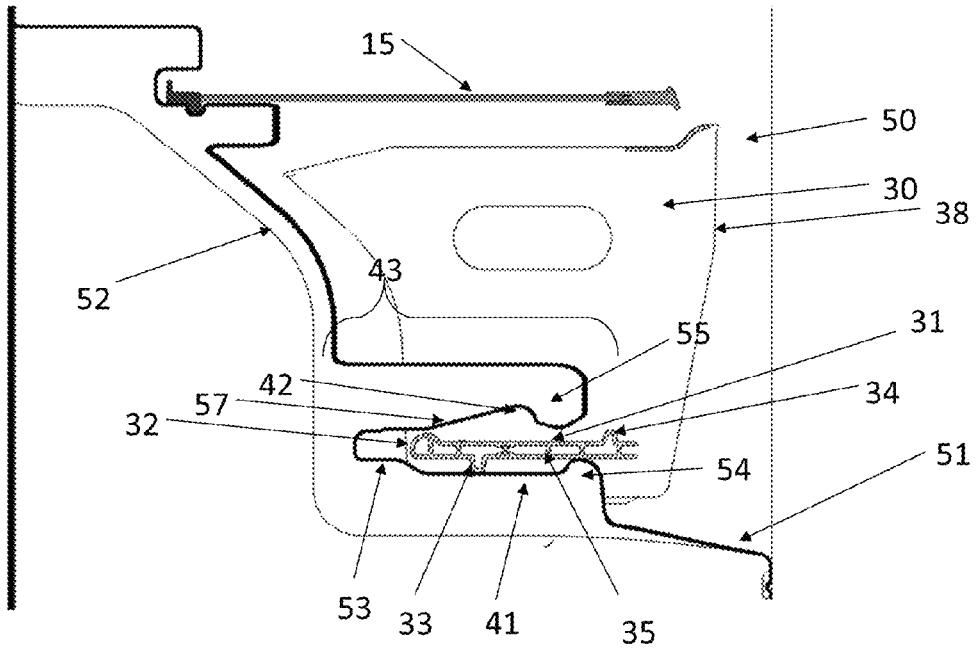
FIG. 10 is a lateral view through the liner with the vegetable drawer in which the vegetable drawer can be seen with a certain extraction portion, which represents Step 2.
Figure 11:
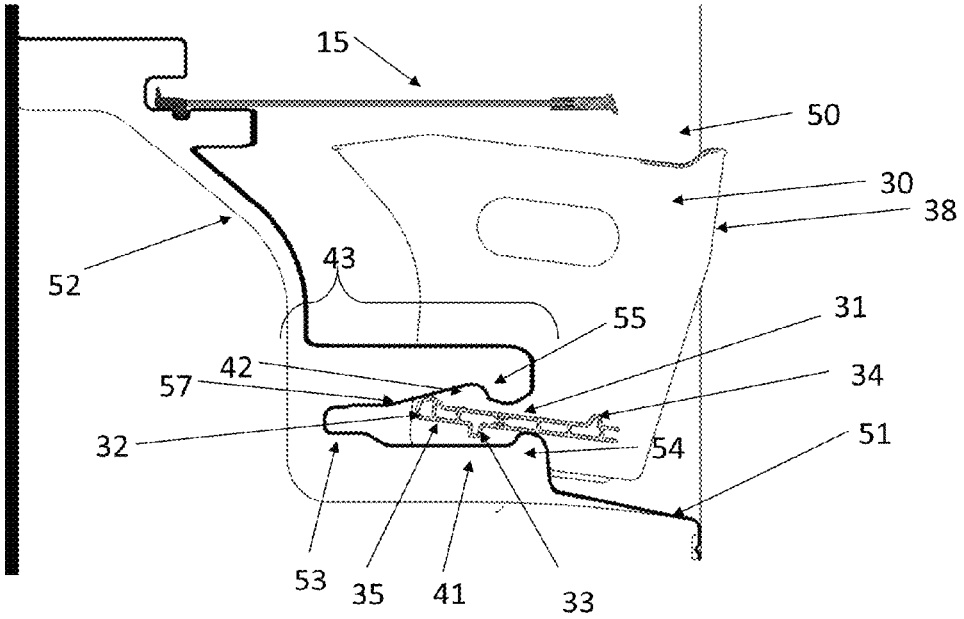
FIG. 11 is a lateral view through the liner with the vegetable drawer in which the vegetable drawer can be seen with a certain extraction portion, which represents Step 3.

FIGS. 9, 10, 11 12 allow us to see in addition to understand, the introduction/extraction mechanism of the vegetable drawer 30; FIG. 9 allows us to see the referred to vegetable drawer 30 in its resting or closed position; from which we can note that the head 32 is completely housed in the neck in C 53, one can also note that the lower face of the lower crossbar 35 rests on the crest of the barrier 54, the contact surface 48 of the skate 33 rests on the upper face of the lower bay 41; the crest 46 itself, from the hump 34, is in contact with the lower face of the stump 55; this is how the appendage 31 is supported by the rail 43 in this resting position represented in FIG. 9, now then supposing that the vegetable drawer 31 is somewhat extracted, such as illustrated in FIG. 10, what can be noted at a first glance is that the head 32 is no longer found housed in the neck in C 53, the contact surface 48 of the skate 33 continues to be in contact with the upper wall of the bay 41 which creates a support point for the appendage 31, another support point can be found between the high point of the barrier 54 and the lower face of the lower crossbar 35; it should be highlighted that given the distance between these support points of the frontal face 35 of the vegetable drawer 30, it remains in a vertical position. Continuing on to FIG. 11, we can note that the head 32 is in direct contact with the face of the a lower bay 41, the remaining contact point is provided by a high point of the barrier 54 which comes into contact with the lower face of the lower crossbar 35, which allows the vegetable drawer 30 to begin to rotate, having the rotation center at the contact point between the lower face of the lower crossbar 35 and the high point of the barrier 54; in this manner, the face 38 of the vegetable drawer 30 loses its vertical positioning, having an angle different than zero in relation to the vertical. Lastly, we shall discuss FIG. 12, and it should be highlighted that at all times, the appendage 31 is always supported by two support points over the rail 43, the extraction mechanism allows that the head 32 be able to be extracted from the neck in C 53 so that in a cam following manner, it may be able to slide over the straight slope 57 until reaching the gulf 42, where it is coupled thanks to both the gulf 42 as well as the head 32 having an arc in a circumference shape, additionally, at this final point of the runner, part of the face of the stump 55 comes into contact with the upper face of the back part of the upper crossbar 44, in this manner aiding the coupling of the head 32 in the gulf 42; now then, the skate 33 from its resting position, until the end of the runner has been sliding along the length of the bay 41, at the final point of the runner the skate 33 which, in its resting position as well as at the beginning of the extraction of the vegetable drawer 30, served as support given the contact surface 48 having contact with the upper face of the lower bay 41, in the final runner position or open vegetable drawer, the skate 33 now serves as a bump or limit upon a vertical face coming into contact with a face of the barrier 54, which does not allow the appendage 31 to continue advancing through the channel 56, and thus the barrier 54 which is in contact with a vertical wall of the skate 33, as well as with the lower face of the lower crossbar 35, in addition to the coupling between the head 32 and the gulf 42, keep the vegetable drawer 30 in equilibrium, which itself in this position holds an $\alpha$ aperture angle between 10° up to 60°, allowing that the distance between the upper border of the inner face of the wall 38 to the front end of the shelf 15 (distance "b") be allowed to be the greatest possible and above all, greater than the "a" dimension of prior art.

Figure 12:
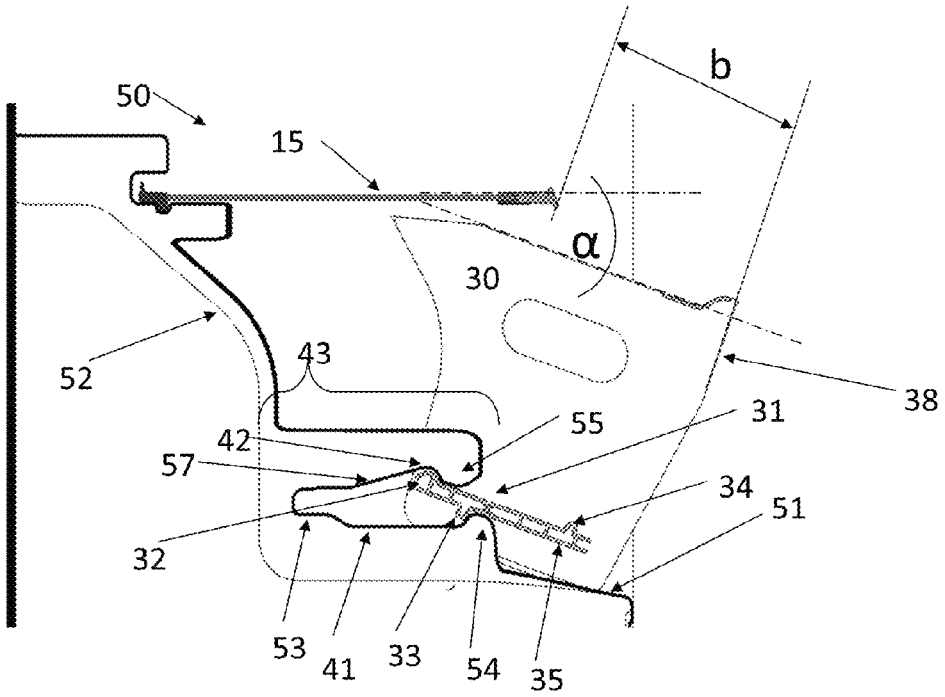
FIG. 12 is a lateral view through the liner with the vegetable drawer in which the vegetable drawer can be seen where it is completely extracted or in its open position, which represents Step 4.

In an alternative embodiment of the invention, when the vegetable drawer 30 is completely extracted or in its open position such as is illustrated in FIG. 12, the front part of the floor 40 of the vegetable drawer 30, may be able to rest on the floor of the liner 51 of the cavity 14 of the refrigerated cabinet, and this may help when heavy loads are present, that is, when the user has introduced a large amount of objects or these themselves may be very heavy, and supporting the front part of the flooring 40 of the vegetable drawer 30 on the floor of the liner 51 helps to distribute the weight among all the support points described in the immediate above paragraph, reducing the forces at the points of contact of the appendage 31 with those of the rail 43, also described in the immediate above paragraph as well as illustrated in FIG. 12.

Another alternative embodiment of the present invention, takes place when the appendage 31 which is found over the outer face of the lateral walls 37 of the vegetable drawer 30 may be found at any given height over the outer face of the lateral walls 37, that is, in the preferred embodiment of the present invention, the appendage 31 is found placed on the lower part of the outer face of the lateral walls 37 of the vegetable drawer 30; in an alternative embodiment of the present invention, the appendage 31 could also be set in the central area of the outer face of the lateral walls 37 of the vegetable drawer 30; in yet another alternative embodiment of the present invention, the appendage 31 can be found on the high or upper part of the outer face of the lateral walls 37 of the vegetable drawer 30.

Having described the present invention in sufficient detail, it is found as possessing novelty, inventive activity as well as industrial application; and it is given all of the above, that the following claims are being claimed:

The invention claimed is:

1. A refrigerated cabinet comprising a cabinet, thermal insulation, a liner with a flooring, which help it to form a cavity which may house objects to be refrigerated, with at least one shelf and one door, the refrigerated cabinet comprising a vegetable drawer with pair of lateral and opposite walls a front wall, a back wall and a flooring, wherein the lateral and opposite walls comprise an appendage integrated by a head, an upper crossbar, a lower crossbar with a lower face, a skate with a vertical face and a hump; said appendage running within a rail comprising a channel formed by a barrier, a lower bay with an upper face, a neck in C, a straight with an inclination, a gulf and a stump; with the peculiarity that when the vegetable drawer is found in its resting or closed position, the front wall of said vegetable drawer is in close proximity to the vertical; the head is coupled within the neck in C, the skate is in contact with the upper face of the lower bay, and the barrier is in contact with a portion of the lower face of the lower crossbar; and when the vegetable drawer is extracted in its final runner position the vegetable drawer has an $\alpha$ aperture angle between 10° C. up to 60° C.; wherein the head is coupled to the gulf of the rail, the barrier is in contact with the vertical face of the skate as well as with a portion of the lower face of the lower crossbar.

2. A refrigerated cabinet such as described in claim 1, wherein the rail is not protruded over a lateral face of the liner, but rather, it is assembled or coupled unto by means of at least one of screws, rivets, agglutinant glue and welding.

3. A refrigerated cabinet such as described in claim 1, wherein the flooring of the vegetable drawer is partially supported by the flooring of the liner when the vegetable drawer is found completely extracted or in its open position.

4. A refrigerated cabinet such as described in claim 1, wherein the appendage of the vegetable drawer is found at the lower part of an outer face of the lateral wall of the vegetable drawer.

5. A refrigerated cabinet such as described in claim 1, wherein the appendage of the vegetable drawer is found at the central area of an outer face of the lateral wall of the vegetable drawer.

6. A refrigerated cabinet such as described in claim 1, wherein the appendage of the vegetable drawer is found at the high or upper part of an outer face of the lateral wall of the vegetable drawer.

* * * * *